United States Patent [19]

Francke et al.

[11] Patent Number: 4,650,419

[45] Date of Patent: Mar. 17, 1987

[54] PROCESS AND APPARATUS FOR WEAPONS FIRE SIMULATION

[75] Inventors: Erwin Francke, Groebenzell; Ulrich Frie, Petershausen; Juergen Poeschel, Dachau, all of Fed. Rep. of Germany

[73] Assignee: Krauss-Maffei A.G., Fed. Rep. of Germany

[21] Appl. No.: 698,430

[22] Filed: Feb. 5, 1985

[30] Foreign Application Priority Data

Feb. 7, 1984 [DE] Fed. Rep. of Germany ..... 3404203

[51] Int. Cl.[4] ..... F41G 1/00

[52] U.S. Cl. ..... 434/16

[58] Field of Search ..... 434/16, 17, 19, 20, 434/21, 22, 23

[56] References Cited

U.S. PATENT DOCUMENTS

| | | | |
|---|---|---|---|
| 3,483,636 | 12/1969 | Knapp et al. | 434/22 |
| 4,290,757 | 9/1981 | Marshall et al. | 434/20 |
| 4,302,191 | 11/1981 | Weibull . | |
| 4,342,556 | 8/1982 | Hasse | 434/21 |
| 4,533,327 | 8/1985 | Kratzenberg et al. | 434/20 |

FOREIGN PATENT DOCUMENTS

| | | |
|---|---|---|
| 2148157 | 7/1979 | Fed. Rep. of Germany . |
| 3023516 | 1/1982 | Fed. Rep. of Germany . |
| 3222970 | 12/1983 | Fed. Rep. of Germany . |
| 3329747 | 7/1985 | Fed. Rep. of Germany . |

*Primary Examiner*—Leo Picard

*Attorney, Agent, or Firm*—Robert J. Koch

[57] ABSTRACT

A process for the simulation of weapons fire for gunner training, particularly for the gunners of armored vehicles. The process allows the exact evaluation of every shot, including its prehistory, permits the accurate determination of the location of a hit and allows a simple evaluation of the shot—even under field maneuver conditions. The process provides that every target emitting a characteristic radiation which is received by a television camera together with the image of the target and transmitted to a control center. The signal received further contain coded characteristics for the identification of the vehicles providing the target image, so that if the reticule is located on the target at the instant of firing, a score is detected and a smoke charge may be optionally ignited on the target by a coded radio command.

22 Claims, 1 Drawing Figure

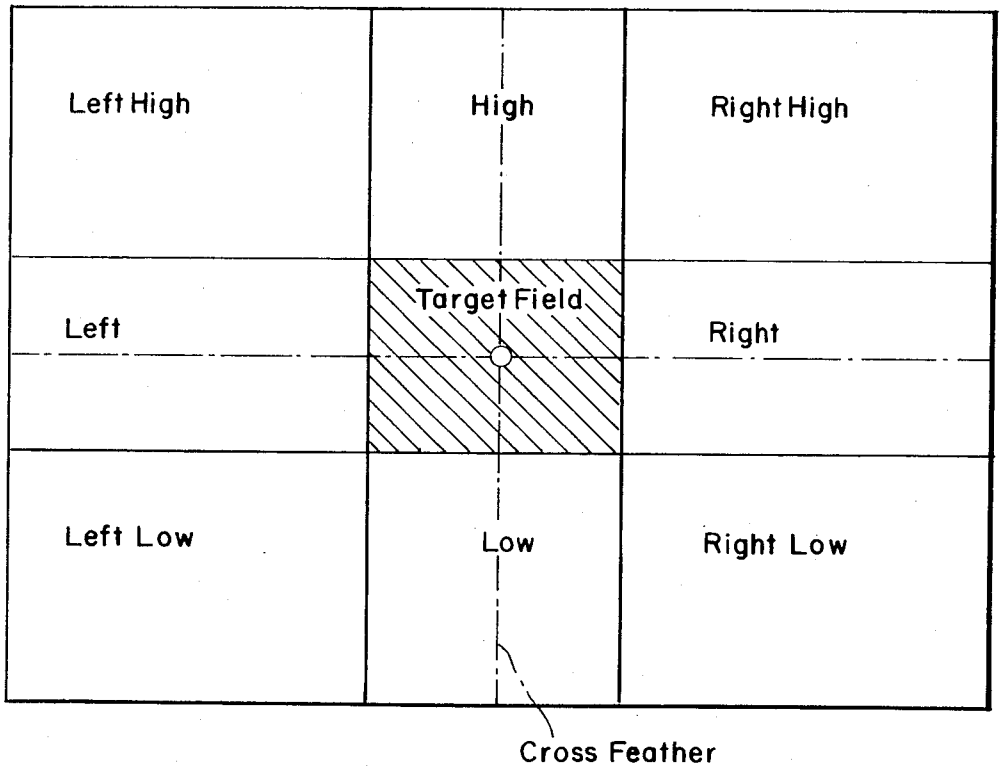
Right High
High
Left High
Right
Target Field
Left
Right Low
Low
Left Low
Cross Feather

PROCESS AND APPARATUS FOR WEAPONS FIRE SIMULATION

BACKGROUND OF THE INVENTION

The invention relates to a process for weapons fire simulation and an apparatus for its embodiment.

It is known from television training installations that it is possible for an instructor observing the television display to accurately evaluate any shot and also to take into consideration the tracking of the target by the gunner, i.e., the "history" of the shot. This represents a particularly substantial advantage during moving exercises. The disadvantage of the known television training installation consists of the relatively involved evaluation during combat training under field maneuver conditions.

A training installation using a laser fire simulator is also known, which indicates a score by the ignition of a smoke charge, and which may be simply evaluated. A laser simulator may be evaluated without difficulty even in combat training under maneuver conditions. The disadvantage of this known laser simulator is that the system cannot be used for fire evaluation with live ammunition. Because the evaluation is restricted to the indication of a score, a consideration of the history of the shot is not possible. In spite of the technically very extensive system and the highly involved adaptation, it is not feasible to accurately locate the position of the hit.

SUMMARY OF THE INVENTION

It is an object of the present invention to realize the accurate evaluation of each shot including its history in a process of the aforementioned type, both in preliminary gunnery training and in combat training under maneuver conditions. It is a further object of the present invention to afford an exact determination of the impact location and to assure simple evaluation even under maneuver conditions.

These objects are attained according to the process and apparatus according to the present invention.

The process according to the invention is superior to the known laser fire simulators not only because significantly less effort is required for its technical embodiment, but also primarily because it permits the accurate evaluation of the position of impact and the preliminary history of each shot. The present process also has the advantage that it is safe for all persons involved; it requires no safety zones as does the use of laser beams.

A further development of the process according to the invention realizes an automatic enhancement of training results with a relatively slight additional effort and realizes this while simultaneously relieving the instructor involved. In this embodiment, automatically produced acoustic information instantaneously transmitted to the gunner in speech form does not divert him from his principal task (i.e., aiming), but facilitates the task of an improved subsequent shot.

The production of acoustic information is effected according to the invention by means of so-called speech generators, actuated by range specific signals. Speech generators of this type are freely programmable within a predetermined range, i.e., they may emit for example the acoustic output signal "low right", when the signal correlated with the area involved is applied to the input of such a generator.

Compared to the transmission of information by optical means, for example, which may be effected by superposition onto the field of vision of the gunner, acoustic information transmission is advantageous not only because it does not divert the attention of the gunner from his proper tasks, but also because it is immediately understandable and applicable with absolute unambiguity without further comparisons, references or surveillance. In this manner, expressed in simple terms, a virtual "automatic instructor" is made available, providing immediate and reliable information during both preliminary gunnery training and under field maneuver conditions. This is highly advantageous for training purposes.

Acoustic evaluation may be combined with optical evaluation according to a further embodiment of the invention. It is also possible to effect a division such that the gunner receives the information acoustically, while it is being displayed optically in a center.

To evaluate the prehistory of a shot, the evaluation may be performed according to yet another embodiment in a manner such that at least the instructor receives signals to indicate passage through the identification ranges. The signals may be in the form of luminous displays. When the individual luminous displays are activated for a certain duration, a virtual record of the prehistory of a shot is provided. Recording the signal in a memory is optional.

The apparatus for the embodiment of the process of the invention may be technically adapted in a simple manner without problems, and requires no complex configuration prone to failure. In spite of its multiple evaluation capabilities, the apparatus may be rapidly adapted with respect to the technical equipment and simply adapted to actual conditions encountered in practice.

Further objects, features and advantages of the present application will become apparent from the detailed description of preferred embodiments, which follows, when considered together with the attached figure of drawing.

BRIEF DESCRIPTION OF THE DRAWINGS

The single FIGURE shows an example of a possible layout of evaluating fields.

DETAILED DESCRIPTION OF THE PREFERRED EMBODIMENT

In a preferred embodiment, at least one specifically pulse-code modulated signal beacon is used to indicate the target objects and target vehicles, respectively. The signal beacon emits short wave IR radiation recognizable by a television camera but not visible to humans, because it is outside the visible range. In place of pulse code modulation, any other type of modulation may be used, provided that it is characteristic of the target object concerned and that it may be recognized and received by television cameras.

Depending on the specific target object, which may be stationary or mobile, either omnidirectional signal beacons are used, or several signal beacons are employed if a single signal beacon is not to be omnidirectional. This is primarily true in the case of vehicles, particularly armored vehicles, where it is essential that the signal beacons be visible below the upper outline of the vehicle. In this manner, it is avoided that a vehicle under cover is represented as visible and thus susceptible to attack, even though the vehicle may actually be under cover, a marker light mounted on the top side of the vehicle protrudes from the cover. The marker lights may be fastened to the vehicle by magnetic holders so that, on the one hand, the rapid and easy equipment of the vehicle with marker lights is possible, and, on the other hand, the specific conditions of the vehicle may be taken into account by proper positioning of the lights.

A further characteristic of the invention comprises the use of signal beacons which, in addition to, or, in the alternative, to a radiation receivable by a television set, further emit a suitably coated IR radiation receivable by thermal imaging devices. Switching between the two types of radiation or the elimination of one of the two radiations by means of suitable filters are possible. The signal beacons may have a configuration such that depending on the outline of the target or the vehicle, respectively, they provide different sector identifications, thereby making possible the targeting of evaluation zones.

The use of a television camera to receive the pulsed code identification of signal beacons leads to particularly simple detection of the output signal, because the television camera is adjusted accurately in relation to the graticule. The employment of receivers separate from the television camera receiving the target image in a periscopic ocular lens is somewhat more involved, but is also a possible variant.

The signal beacons may be operated in both a synchronized and an unsynchronized manner. In the case of unsynchronized operation, the duration of a light pulse corresponds preferably to at least the duration of two television semi-images. In case of synchronized operation, the pulses of the signal beacons are preferably synchronized by radio as a function of the television camera. A particular advantage of this is that the transmission of the synchronizing signal and possible further signals. Particularly, a scoring signal may be effected by audio devices built into the vehicles.

The position of the signal beacons is detected and, if necessary, the type of signal beacon evaluated relative to the reticule or cross hairs in the monitor display. The monitor display provided in the center is capable of being switched in a conventional manner to the individual vehicles or the television receivers of the vehicles. The monitor image may be divided specifically in the vicinity of the center of the cross hairs into zones of variable position and magnitude. The parameters for the variation of size and position are preferably the distance, the type of target (i.e., for example, armored vehicles, trucks or the like), and the appearance of the target vehicle.

Prior to the beginning of a training run, the point of reference for evaluating the position is set manually at the center of the target reticule.

The point in time of the evaluation of the impact position and the correction of the evaluating zone may be located within a period of time following the firing pulse, corresponding to the time of flight of the ammunition selected for the corresponding distance. In this manner, an impact field correction may be obtained, which also takes into account the moving velocity of the target that may be determined from a preceding target tracking process.

The impact zones may be further evaluated with respect to their effect on the vehicle and the effects related to the ammunition selected and the distance. The technical effort required for this purpose is slight, but the practical advantages obtained thereby are large.

The range finders present on the vehicles, especially laser range finders, may be used without difficulty for the determination of the distance required.

An advantage important for actual practice is that the target identified may be displayed as a visual record on the instructor's screen. This may be accomplished without difficulty because of the continuous electric decoding of the signals received.

The entire system according to the invention may be capable of operating independently of an observer or instructor. All of the vehicles participating in an exercise are preferrably equipped with the devices required for firing, for the indication of hits and for the evaluation of shots. When a hit is detected in a firing vehicle, a corresponding signal is sent to the vehicle hit, and when the smoke charge of the latter is ignited, the hit is made optically recognizable. In every case, the aforedescribed process is suitable for all exercises of preparatory fire training and for combat training on a tank course. The possibilities of evaluation are universal and optimal with respect to both the indication of scoring and the differentiated evaluation of shots. The effort required for the establishment of the system is relatively low. The system may be instituted by software to a substantial extent, and is thus simply adaptable to prevailing requirements.

The above-described measures may be extended by the range specific signal evaluation explained in the FIGURE. Specifically, in addition to the aforementioned impact indication, eight range specific signals are provided in decoding. This causes no problems with respect to the technical effort required. For example, a digital signal may be assigned to each of the evaluation fields shown (left high, high, right high, right low, low, left low and left). The signal is capable of actuating the speech signal generators (not shown).

If, for example, the target or the target area, respectively, is in the "left high" field at the instant of the shot, the signal produced at this instant in decoding actuates the corresponding speech signal generator which immediately provides the gunner with the information "left high" acoustically. The same is true for all of the other evaluating fields.

In this manner, both a constant surveillance of the gunners to be trained and intermittent monitoring may be effected. If the gunner is to be monitored intermittently, it is of particular advantage to transmit the signal to the monitoring station of center by means of remote control, i.e., to activate and deactivate the transmission by code, so that the gunner is unaware of whether he is being observed or not. The coded activation and deactivation may be effected by using the transmission means already provided for impact detection, so that the additional effort required for this coded activation and deactivation is minimal. A further advantage is that the few transmission channels available are used in an optimum manner and, above all, that interference between adjacent training areas may be avoided. If, for example, two transmission channels are assigned to a first unit and two further transmission channels to a second unit, mutual interference is prevented. Thus, it is possible that, within the individual units, a plurality of individual vehicles may participate in the exercise by means of the coded activation and deactivation of the systems provided in the vehicles; and, that the instructor is capable of observing two individual gunners simultaneously in a freely variable time sequence.

What is claimed is:

1. A process for simulating weapons fire for the purpose of training gunners, particularly the gunner of armored vehicles, comprising the steps of:

emitting a coded identification signal from objects designated as targets for reception by television cameras;

receiving a target image including the coded identification signal with a television camera associated with a gun sight of a firing vehicle;

separating and decoding said identification signal so as to unambiguously identify said target;

evaluating said target image as a function of its position in the gun sight upon firing;

emitting an evaluation signal as a function of the position of said target image in said gun sight at the time the gun is fired displaying said target image and said evaluation signal.

2. A process as recited in claim 1, further comprising the steps of transmitting said evaluation signal to an identified target when the position of a target image in said gun sight corresponds to a hit, and igniting a smoke charge on said target when said evaluation signal is received.

3. A process as recited in claim 2, wherein said evaluation signal comprises a coded radio command when the position of said target image in said gun sight corresponds to a hit.

4. A process as recited in claim 2, further comprising the steps of:

converting said evaluation signal into immediate acoustic deviation information;

transmitting said immediate acoustic deviation to an operator.

5. A process as recited in claim 4, wherein said converting step comprises using speech generators for converting said coded evaluation signal into said immediate acoustic deviation information, and wherein said evaluation signal is dependent on the region in which said identification signal is positioned in said gun sight.

6. A process as recited in claim 1, further comprising the steps of:

converting said evaluation signal into immediate optical deviation information;

transmitting said immediate optical deviation information to an operator.

7. A process as recited in claim 6, further comprising the step of superimposing said immediate optical deviation information on the field of vision of an operator.

8. A process as recited in claim 6, further comprising the step of displaying said immediate optical deviation information on a separate indicator board in a control center.

9. A process according to claim 1, wherein said identification signal is emitted from signal beacons.

10. A process according to claim 9, wherein said signal beacons are omni-directional for emitting a characteristic signal, and are attached to a vehicle having an upper profile outline.

11. A process according to claim 10, wherein said signal beacons are attached to said vehicle below said upper profile outline, by magnets.

12. A process according to claim 1, further comprising the step of recording the history of the position of said identification signal in said gun sight before said firing step.

13. An apparatus for weapons fire simulation comprising:

means for emitting a coded identification signal associated with a target;

means for receiving an image of said target and said coded identification signal coupled in an axially parallel fashion with an aiming device;

means for evaluating said image upon simulated firing coupled to said camera means;

means for decoding said coded identification signal coupled to said camera means; and means for displaying said image and evaluation of said simulated firing coupled with said means for evaluating.

14. An apparatus as in claim 13, wherein said means for displaying is responsive to said means for decoding, for displaying a decoded identification signal.

15. An apparatus according to claim 14, wherein the means for emitting is an infrared marker light having radiation wave length outside the wave length range of visible light.

16. An apparatus according to claim 15, wherein the marker light is mounted on the target in a manner such as to be visible all around.

17. An apparatus according to claim 15, wherein said means for emitting operate impulsively with pulse code modulation, wherein the duration of a light pulse corresponds at least to the duration of two half video images of the camera.

18. An apparatus according to claim 15, wherein said targets further comprise vehicles having several marker lights mounted below an upper profile outline of the target vehicles.

19. An apparatus according to claim 18, wherein the marker lights emit different sector identifications as a function of the outline of the target vehicle.

20. An apparatus according to claim 18, further comprising magnets for mounting said marker lights.

21. An apparatus according to claim 15, further comprising magnets for mounting said marker lights.

22. An apparatus according to claim 13, wherein said means for emitting impulsively with pulse code modulation, wherein the duration of a light pulse corresponds at least to the duration of two half video images of the camera.

* * * * *